US006520832B2

(12) United States Patent
Devita et al.

(10) Patent No.: US 6,520,832 B2
(45) Date of Patent: Feb. 18, 2003

(54) APPARATUS AND METHOD FOR DYNAMICALLY ADJUSTING THE GIRTH OF A GARMENT FASTENED BY HOOK AND EYE

(75) Inventors: Lucien Devita, Lyons (FR); Mary Gut, Raleigh, NC (US)

(73) Assignee: Ideal Fastener Corporation, Oxford, NC (US)

( * ) Notice: Subject to any disclaimer, the term of this patent is extended or adjusted under 35 U.S.C. 154(b) by 0 days.

(21) Appl. No.: 09/929,441

(22) Filed: Aug. 14, 2001

(65) Prior Publication Data

US 2002/0068506 A1 Jun. 6, 2002

Related U.S. Application Data

(60) Provisional application No. 60/224,996, filed on Aug. 14, 2000.

(51) Int. Cl.[7] ..... A41C 3/00

(52) U.S. Cl. ..... 450/1; 2/251; 24/DIG. 43; 24/DIG. 49

(58) Field of Search ..... 450/13, 14, 17, 450/18, 25, 26, 28, 34, 35, 72, 73, 79, 80, 82, 135–136, 142; 2/96, 251, 252, 257, 259, 263, 264, 265, 336, 338; 24/697.1, 697.2, 592.1, DIG. 43, DIG. 49

(56) References Cited

U.S. PATENT DOCUMENTS

| | | | | | |
|---|---|---|---|---|---|
| 1,421,062 | A | * | 6/1922 | Brenner | 2/251 |
| 1,466,598 | A | * | 8/1923 | Panes | 450/73 |
| 1,584,525 | A | * | 5/1926 | Freeman | 2/263 |
| 2,034,689 | A | * | 3/1936 | Alberts | 2/251 |
| 2,067,371 | A | | 1/1937 | Allis | |
| 2,370,754 | A | * | 3/1945 | Roseman | 24/DIG. 43 |
| 2,681,452 | A | * | 6/1954 | Rabinowitz | 24/697.1 |
| 2,802,215 | A | * | 8/1957 | Alfandre | 2/263 |
| 3,066,310 | A | * | 12/1962 | Roseman | 24/DIG. 43 |
| 3,176,366 | A | * | 4/1965 | Roseman | 24/697.1 |
| 3,208,420 | A | * | 9/1965 | Waldes | 24/DIG. 43 |
| 3,315,277 | A | | 4/1967 | Ruiz | |
| 3,528,140 | A | * | 9/1970 | Waldes | 24/DIG. 43 |
| 3,530,813 | A | * | 9/1970 | Roseman | 2/263 |

FOREIGN PATENT DOCUMENTS

| | | |
|---|---|---|
| DE | 1934 197 | 1/1971 |
| WO | WO 01/91592 | 12/2001 |

* cited by examiner

*Primary Examiner*—Gloria M. Hale
(74) *Attorney, Agent, or Firm*—Roberts Abokhair & Mardula, LLC

(57) ABSTRACT

The present invention is drawn to a hook and eye closure for garments such as brassieres. The eye tape and/or the hook tape is stabilized in a vertical direction, but stretches in a horizontal direction so as to provide a comfortable and self-adjusting fit to garments. The eye tape preferably includes a soft, stretchable backing material that wraps around three edges of the eye tape and is heat-sealed to the front side. This provides a soft, seam-free back and edge portion to allow increased comfort.

22 Claims, 5 Drawing Sheets

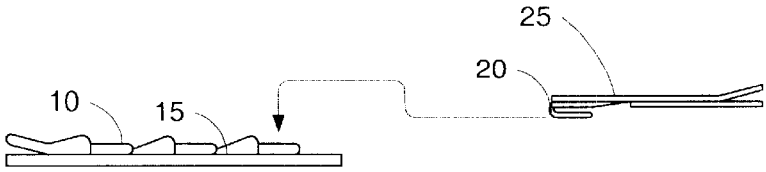
FIG. 1A
FIG. 2A
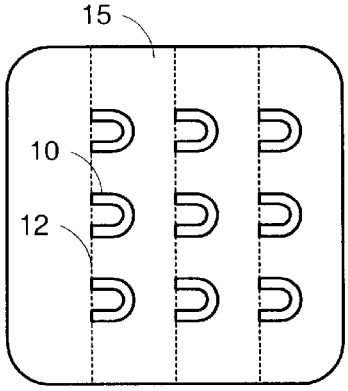
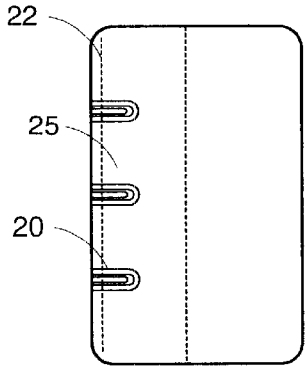
FIG. 1B
FIG. 2B
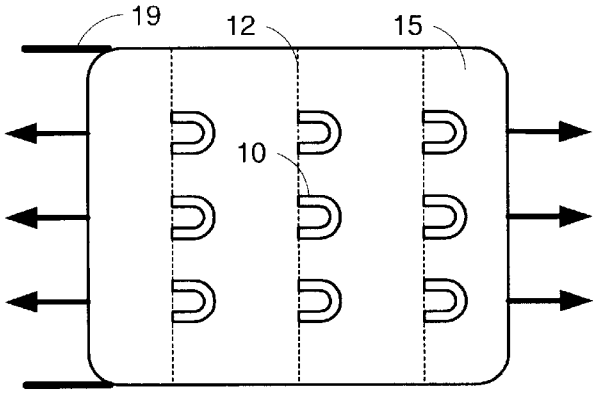
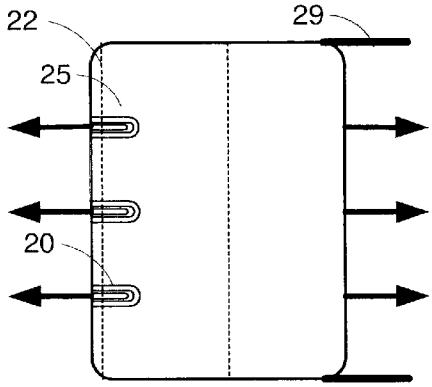
FIG. 1C
FIG. 2C

APPARATUS AND METHOD FOR DYNAMICALLY ADJUSTING THE GIRTH OF A GARMENT FASTENED BY HOOK AND EYE

RELATIONSHIP TO OTHER APPLICATIONS

This application claims the benefit of Provisional Application Serial No. 60/224,996, filed Aug. 14, 2000, which is hereby incorporated by reference.

FIELD OF THE INVENTION

The present invention relates to garments that are fastened with a plurality of hook and eye pairs. More specifically the present invention comprises elastically elongatable eye tape that is useful for brassieres and will dynamically deform in the horizontal plane to adjust to the needs of the wearer.

BACKGROUND OF THE INVENTION

Brassieres have used hook and eye fasteners for more than fifty years. The hooks and eyes are mounted on a stabilized (non-stretchable) fabric, usually a tape. The tape is then mounted on the garment. Typically, a set of vertical columns and rows eyes, usually between two and four in number, are aligned on a tape. Similarly there is a tape containing one corresponding vertical column of hooks such that the number of eyes per each column corresponds to the number of hooks. If there are three hooks in the hook column, there will be three eyes in each vertical column of eyes.

The use of multiple columns of eyes allows for minor horizontal adjustment to the garment's fit. Typically, the eye columns are separated by about five eighths of an inch. In such a case, if there were three columns of eyes mounted on the tape (usually the limit) there would be from five eighths to one and a quarter of an inch adjustment available to the wearer.

If the brassiere is of an incorrect size, discomfort and poor fit are experienced. Studies show that 30% of women buy brassieres of a size too small. Often the brassiere size requirements change over time or even during the day. Multiple columns of eyes provides for some relief. Adjustment capabilities greater than that provided by multiple eye columns are desired. Further, it would be desirable to have a garment automatically adjust (expand or contract) without intervention by the wearer.

BRIEF SUMMARY OF THE INVENTION

It is an object of the invention to provide flexibility to garment size without the wearer having to make an adjustment.

It is a further object of the invention to provide size flexibility to a brassiere without the wearer having to make an adjustment.

It is another object of the invention to provide flexibility to a garment size in a horizontal dimension and not a vertical dimension without the wearer having to make an adjustment.

It is another object of the invention to provide flexibility to a brassiere size in a horizontal dimension and not a vertical dimension in a garment without the wearer having to make an adjustment.

It is yet another object of the invention to provide a elastically elongatable eye tape with smooth edges for comfort.

It is a further object of the invention to provide a process for producing elastically elongatable eye tape using existing eye tape producing machinery.

The present invention is to the use of a stretch fabric tape that holds the eye or both the hook and eye fasteners to a garment, such as a brassiere. In doing so, the tape will stretch if the brassiere is too tight. The fabric tape stretches only in the horizontal direction so as to maintain vertical positioning of the eye portion with the hook portion.

BRIEF DESCRIPTION OF THE DRAWINGS

FIG. 1A illustrates an edge view of eye tape in an arrangement usable for the present invention.

FIG. 1B illustrates the front view of the eye tape of FIG. 1A, comprising three columns and three rows.

FIG. 1C illustrates the front view of the eye tape of FIG. 1B in a stretched position.

FIG. 2A illustrates a cross section of a hook portion for engaging the eyes in FIG. 1A.

FIG. 2B illustrates the back view of the hook tape for engaging the eye tape of FIG. 1B.

FIG. 2C illustrates the back view of the hook tape of FIG. 2B in a stretched position.

DETAILED DESCRIPTION OF THE INVENTION

Figure 3A:
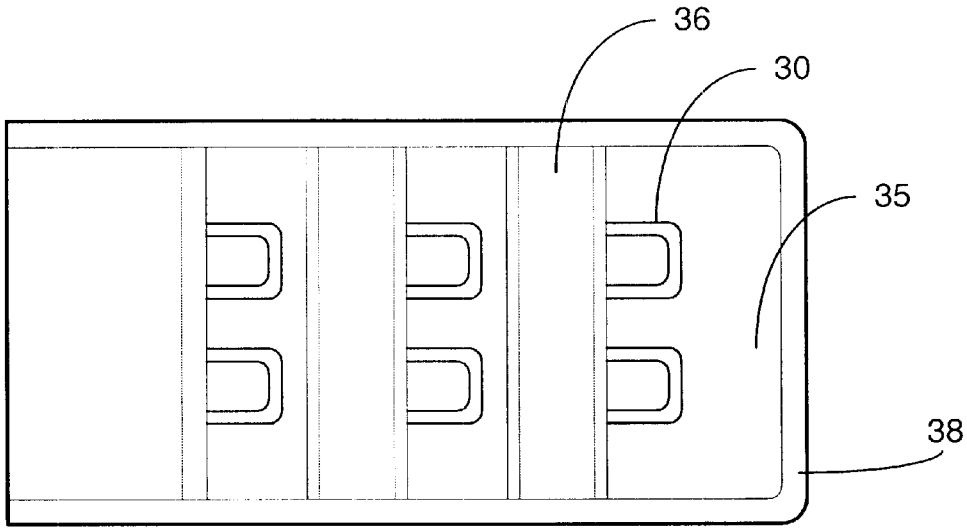
FIGS. 3A–C illustrate the front, cross section construction, and back of a second embodiment of the present invention, respectively.

Although the addition of flexibility to a hook and eye closure, such as used in a brassiere, may seem simple at first blush, a workable solution for use in a brassiere is by no means trivial. Proper operation of a hook and eye closure for a brassiere has traditionally depended on suitable stability of the hook and eye tape used so as to assure proper alignment of the fastener and acceptable durability of the garment. Mere substitution of the stabilized tape material with a stretchable material would result in unacceptable misalignment, twisting, and premature failure of the fasteners.

To solve these problems, the present inventor selected a material for the tape that stretches in only one direction so as to enable elastic horizontal elongation while maintaining vertical stability for proper alignment of hooks and eyes.

FIG. 1A illustrates an edge view of the eye tape in an embodiment that uses three columns of eyes 10 spaced in an equidistant manner on a horizontally-elastic yet vertically-stable material 15, hereinafter referred to as uni-stretch tape 15. A corresponding edge-view of hook tape is illustrated in FIG. 2A wherein one row of hooks 20 are mounted on uni-stretch tape 25. The outer portions of both the eye tape and the hook tape preferably include openings for attachment to a garment, such as by sewing.

FIG. 1B illustrates a front view of the eye tape from FIG. 1A, showing three eyes 10 in each column, again spaced in an equidistant manner on the uni-stretch tape 15 and sewn in position in the usual manner resulting in seams 12. The corresponding back-view of the hook tape from FIG. 2A is illustrated in FIG. 2B, wherein the column has three corresponding hooks-20 mounted on uni-stretch tape 25 in the usual manner resulting in seams 22.

FIGS. 1C and 2C illustrate the respective eye tape and hook tape of FIGS. 1B and 2B in the stretched position, such as when attached to corresponding girth portions of a garment such as brassiere sections 19 and 29, respectively. The illustrated dimensions are not to scale and are not meant to be a limitation, but are disclosed to demonstrate the unidirectional nature of the elasticity of the eye tape or hook tape.

In use, either one of the eye tape and hook tape or both can be fabricated in this manner. When the eye tape is elastic, a stable hook tape with one column of hooks can be used. When the hook tape is stretchable, it is preferable to provide an extended uni-stretch tape portion so as to provide sufficient width to the tape for adequate elongation, as shown between the seams in FIG. 2C.

The typical elongation for use in a brassiere will be between 10–50% with 20–30% being a preferred range. Of course, other applications can have different requirements.

A suitable uni-stretch material is nylon fabric with unidirectional elastic fibers such as spandex in a proportion needed to provide the desired elongation in the horizontal direction only.

Although it is possible to practice the present invention with the substitution of uni-stretch tape for traditional stabilized tape, additional problems arise due to the stretching when used with brassieres.

Traditional stabilized hook and eye tape for brassieres usually has heat-sealed edges. The minor roughness of the heat-sealed edge where it covers the seam does not cause a problem when those rough portions on the eye tape in contact with the wearer do not move much relative to the wearer, such as with traditional stabilized eye tapes. However, the added stretch of the present invention allows the heat-seal seams of the eye tape to move more relative to the wearer, causing irritation.

The embodiments illustrated in FIGS. 3A–C, 4A–C and 5A–C address this comfort issue by providing a soft, stretchable backing material 38, 48, 58 that wraps around three edges of the eye tape and is heat-sealed to the front side. This provides a soft, seam-free back and edge portion to allow increased comfort. DuPont Lycra® and other similar materials having sufficient softness, stretch, and flexibility are suitable for use as the soft, flexible backing material 38, 48, 58. A preferred heat sealing technology to accomplish the front-only heat-seal is available from Brero & Co., AG of Alleestrasse 25, 2503 Biel, Switzerland and described in their PCT application # EPO 0/10352 PCT, filed on Oct. 20, 2000 and originally filed May 29, 2000.

Figure 3B:
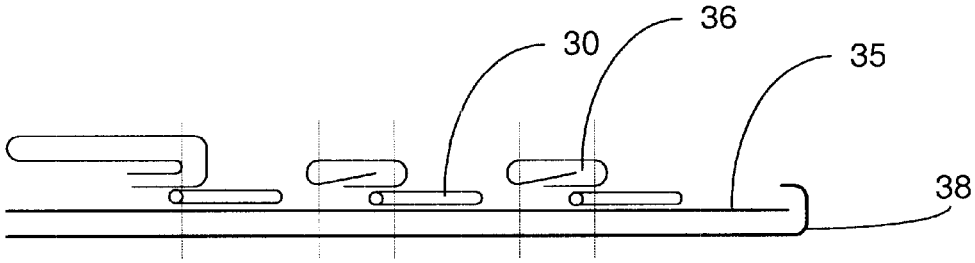
Figure 3C:
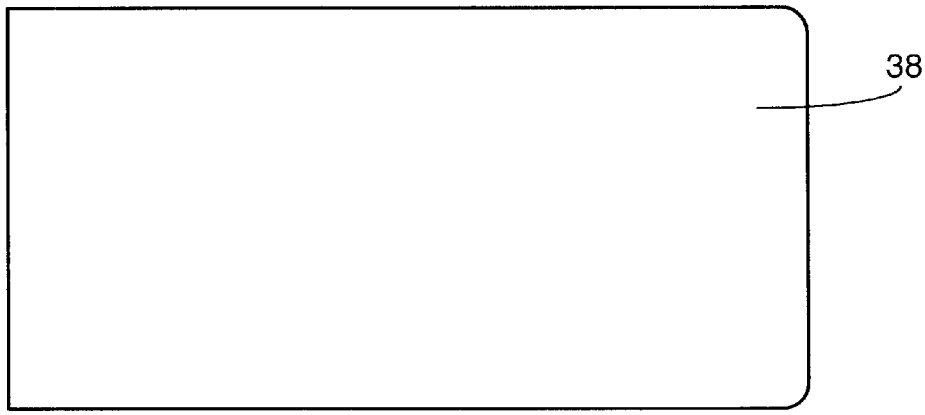
Figure 4A:
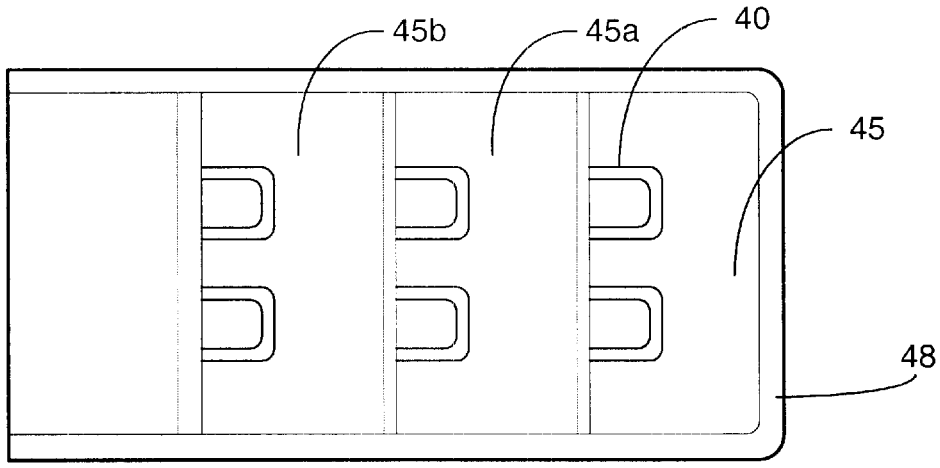
FIGS. 4A–C illustrate the front, cross section construction, and back of a third embodiment of the present invention, respectively.
Figure 4B:
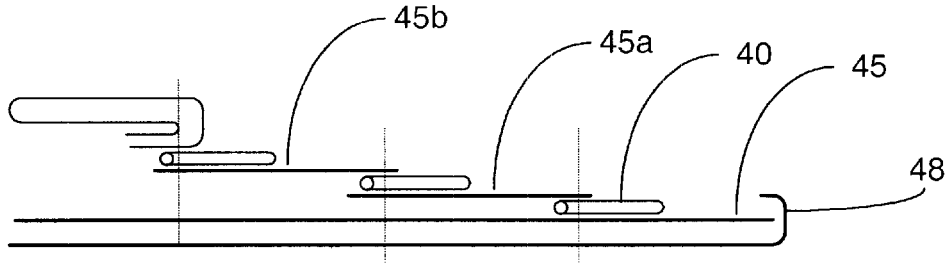
Figure 4C:
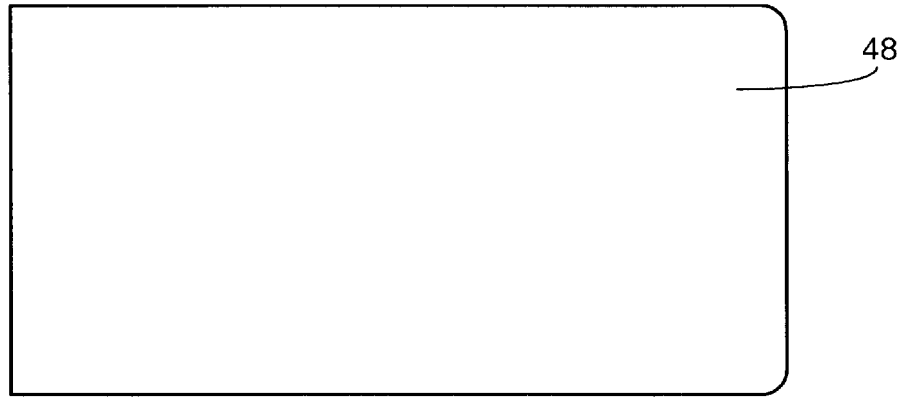
Figure 5A:
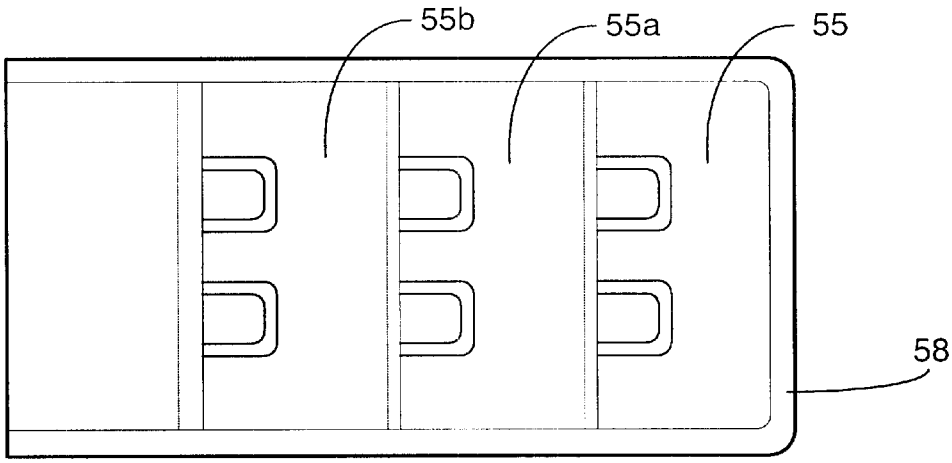
FIGS. 5A–C illustrate the front, cross section construction, and back of a fourth embodiment of the present invention, respectively.
Figure 5B:
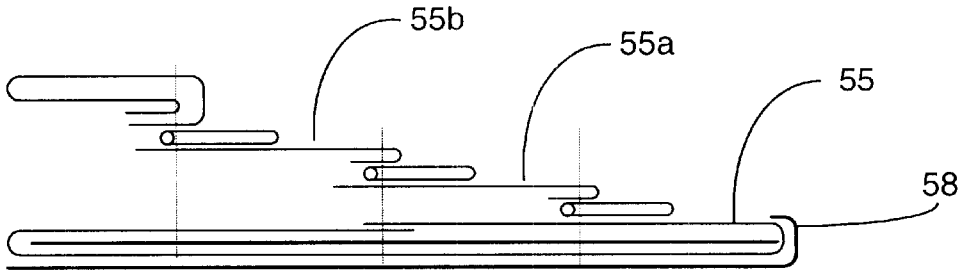
Figure 5C:
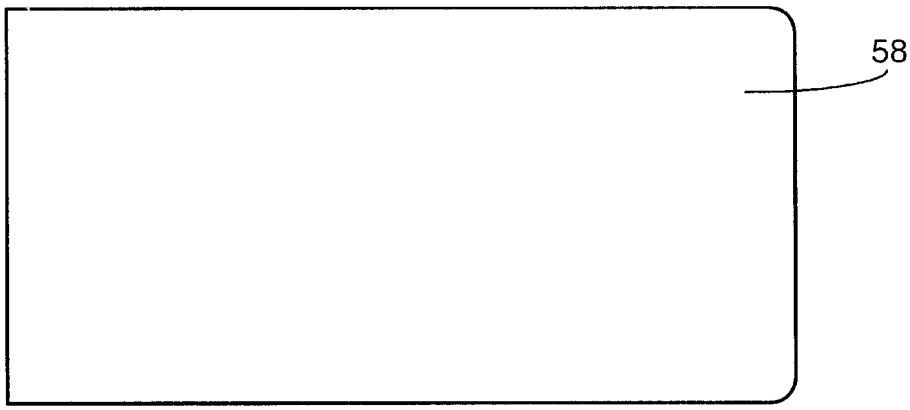

FIGS. 3A–C illustrate an embodiment of the present invention that attaches eyes 30 to uni-stretch tape 35 using rolled strips of stabilized nylon tricot 36 that are stitched to the uni-stretch tape 35.

The process to manufacture the item as shown in FIGS. 3A–C uses a uni-stretch tape 35 as the base material to which is sewn the first and second row of eyes 30 with a narrow strip of stabilized nylon tricot 36. This nylon tricot 36 serves to hide the attachment part of the metal eye 30. By using narrow strips of tricot, the stretchability of the base fabric 35 is preserved, since the area not overlaid with tricot 36 stays unrestricted. The eye row adjacent the garment is also attached with a strip of stabilized nylon tricot. This strip is referred to as the lip, and is used the same as in prior art eye tape. The two narrow strips 36 require a separate sewing step that is not used in prior art eye tape methods. The present inventor modifies regular eyesewing machines for this additional sewing step. After the sewing process, the eye tape is ultrasonically sealed and cut using the Brero & Co. technology wherein an additional layer of soft, stretchable backing material is wrapped around three edges of the eye tape and is heat-sealed to the front side. The eye tape can be sewn with a single column of eyes, two columns, the most common three columns, or four columns.

The hook tape is sewn as a single column. Like the eye tape, it is sewn continuously, and can be sewn either with stabilized nylon tricot, or with uni-stretch material. One sewing stitch line attaches the metal hooks at the desired intervals. The hook tape will be ultrasonically sealed and cut to the desired length, either straight, as it is sewn in a tape with the stitch line near the center, or prefolded, per customer request, This process is the same as in prior art hook tape. The hook tape can also be manufactured with a wider section of uni-stretch material, to afford extra stretchability.

FIGS. 4A–C and 5A–C illustrate embodiments of the present invention that attach eyes 40, 50 to uni-stretch tape 45, 55 using strips of uni-stretch material 45*a*–45*b*, 55*a*–55*b* that are stitched to the uni-stretch tape 45, 55.

The process to manufacture the item as shown in FIGS. 4A–C and 5A–C uses a uni-stretch base strip 45, 55, and sew the metal eyes 40, 50 of the first and second columns by overlaying the eye attachment area with narrower strips of the same unistretch material 45*a*, 45*b*, 55*a*, 55*b*. The eye column adjacent the garment is sewn with either another such strip (not shown), or a stabilized nylon material. After the sewing step, the process continues with ultrasonic sealing, cutting, and attaching stretchable backing and wrap-around edges as described above.

Figure 6A:
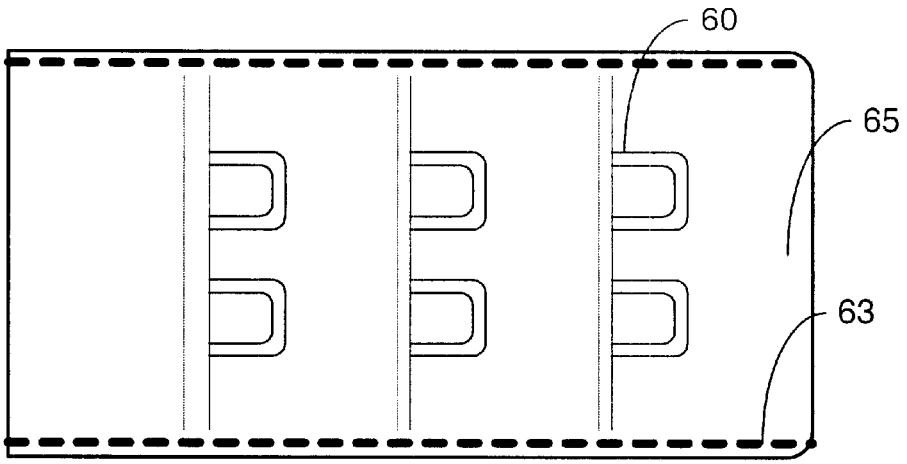
FIGS. 6A–C illustrate the front, cross section construction, and back of a fifth embodiment of the present invention, respectively.
Figure 6B:
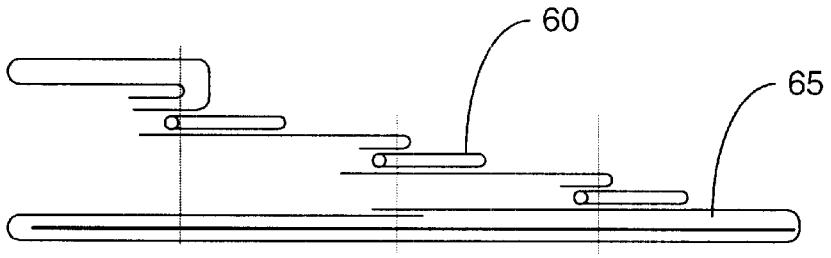
Figure 6C:
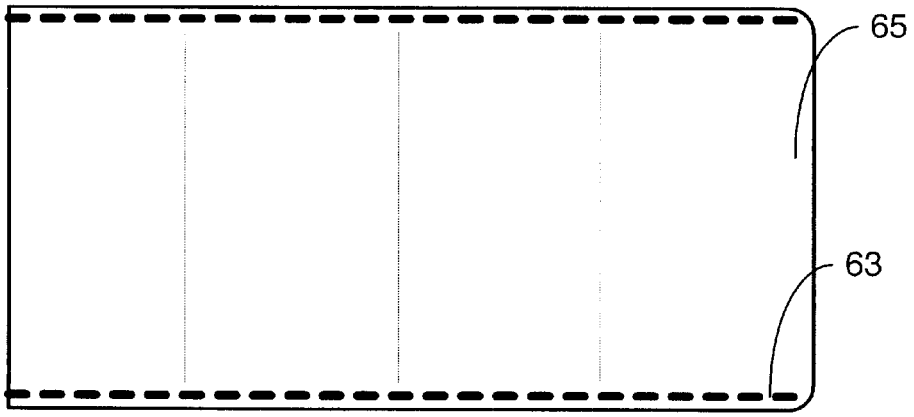

FIGS. 6A–C illustrate an alternate embodiment of the invention wherein the edge roughness problem is addressed using a standard two-sided heat seal formed as a plurality of heat-sealed spots 63. The uni-stretch tape 65 is folded to allow attachment of eyes 60 by stitching.

The process to manufacture the item as shown in FIGS. 6A–C uses standard eye tape equipment and can be made in widths from 57 mm wide to 76 mm wide. This eye tape is made with 100% uni-stretch material, which gives the finished eye tape its horizontal stretch. The ultrasonic sealing line has been moved about 1 mm inside of the cutting line in order to provide a soft edge that does not irritate the wearer. After sealing the tape is cold cut.

In use with a brassiere, the hook tape is attached to one of two back sections of the brassiere. In this embodiment, the hooks are facing inward toward the opposite side of the brassiere to interface with the eyes opposite thereto. The tapes vertical axis is aligned with the back sections' vertical edge.

The eye tape is attached to the brassiere's other back section, facing outward such that the eyes and hooks align and face each other. The wearer fastens the brassiere my inserting each hook into each eye of a corresponding column. Some adjustment will be achieved when the wearer selects the column to use when fastening. If the inboard column of eyes are used, then the minimum horizontal brassiere size will be achieved. If the outboard column of eyes are used, then the maximum horizontal brassiere size will be achieved.

In the event that the brassiere is still too small, the fabric tape holding eyes will stretch. The stretch material has the ability to restore back to its original dimensions and shape.

In another embodiment, the present invention is directed to hook and eye fasteners for use in a brassiere. The present invention provides an advantage over the hook and eye fasteners of the prior art in that the fabric tape to which the hook fasteners and/or eye fasteners are sewn is stretchable. As with any hook and eye fastener, the number of hooks and eyes is preferably the same. Moreover, the hooks in a horizontal row are aligned, the eyes in a horizontal row are aligned, and the hooks and eyes in a fastener are aligned.

According to one embodiment of the present invention, the fabric tape for, either or both, the hook fastener and the eye fastener is made of any suitably stretchable material that is adapted to stretch primarily, and preferably only, in the sideways or horizontal direction, i.e. across the wearer's back. Thus, the fabric tape or tapes provide primarily one way stretch, namely the fabric tape is substantially non-stretchable in the vertical direction and substantially, preferably completely, stretchable in the horizontal direction. Preferably, the fabric tape is made of a stretchable, elastomeric material. The material is a multi-ply material.

In another embodiment of the present invention, both the hook fastener and eye fastener tapes are made of a stretchable material. In this embodiment, it is preferable that the eye fastener tape is less stretchable than the hook fastener tape. The stretch in the eye fastener tape and the hook fastener tape is about 10% to about 15%, and more preferably about 12% to about 15%.

In another embodiment of the present invention, either the hook fastener tape or the eye fastener tape is made of a stretchable material, while the other is virtually or entirely non-stretchable. In this embodiment, preferably, it is the eye fastener tape that is made of the stretchable material.

Basically, whether the hook tape fastener is non-stretchable or stretchable, the eye fastener tape stretches about 10% to about 15%.

In an alternative to any embodiment of the present invention, the base of each hook fastener and each eye fastener is sewn into the material such that the area immediately surrounding each hook fastener and each eye fastener is non-stretchable in the vertical direction and substantially non-stretchable in the horizontal direction. Thus, while the remainder of the tape is stretchable, the base is not.

In another alternative to any embodiment of the present invention, each row of hook fasteners and/or eye fasteners has the ability to stretch separate and apart from the other rows of hook fasteners and/or eye fasteners to the fabric to which the eye fasteners are sewn.

In addition to the various embodiments of the present invention, the stitches use to sew the hook or the eye may, but preferably are not, visible. Moreover in any embodiment, the stitches must not have any harsh edges. Preferably, the edges of the tapes should not be sonically sealed, but instead should be sealed to the inside edge. Preferably, the tape is sealed one/thirty-second of an inch from the inside edge of the tape.

Another aspect of the present invention is that the eye fastener tapes, and more importantly sections in an eye fastener tape, can be of different sideways or horizontal lengths. Thus, there is provided adjustability for large size garments (for full figure women). Also, the eye fastener tape is made so as not to collapse, but instead becomes narrow, when stretched.

In one preferred embodiment, the hook fastener tape is made of five or six sections. The two end sections have an equal sideways or horizontal length. These two end sections preferably have no stretch. Also, they provide a tongue and opening for sewing. The second to fifth sections, or the sections between the two end sections, are stretchable. The stretch of these sections, when the hook fastener tape does not stretch, is about 10% to about 15%, and more preferably about 12% to about 15%.

Although described herein with reference to particular embodiments, one of ordinary skill in the art will recognize that numerous additional embodiments are possible and that various modifications can be made without departing from the scope of the present invention, which is limited only by the claims below. For example, the number of eyes/hooks per column, the number of eye columns, the eye spacing, the column spacing, the fabrics used, the fabric layering arrangements, the sewing or other fastening used, the type of garment, the orientation of the hooks/eyes with respect to the garment, etc. can all be varied for particular applications.

What is claimed is:

1. A hook and eye closure for allowing dynamic girth adjustment of a garment, comprising:

an eye tape, said eye tape comprising:

a base fabric that elongates elastically in a first direction and is stabilized in a second direction perpendicular to said first direction;

at least one eye column positioned on said base fabric wherein said at least one eye column extends in said second direction; and at least one eye row in said at least one eye column, each row containing an eye secured to said base fabric; and a hook tape, said hook tape comprising:

a hook base fabric;

one hook column positioned on said hook base fabric in said second direction wherein said second direction of said hook base fabric is stabilized; and at least one hook row in said at least one hook column, each row containing a hook secured to said hook base fabric.

2. The apparatus of claim 1, further comprising:

a plurality of parallel eye columns spaced apart from each other in said first direction;

a plurality of eye rows in each eye column spaced apart from each other in said second direction; and a plurality of hook rows in said one hook column spaced apart from each other in said second direction and corresponding in number to said plurality of eye rows.

3. The apparatus of claim 1, wherein said hook base fabric is stabilized in said first direction.

4. The apparatus of claim 1, wherein said hook base fabric elongates elastically in said first direction.

5. The apparatus of claim 1, wherein said closure allows between about 10% and about 50% elongation.

6. The apparatus of claim 1, wherein said closure allows between about 20% and about 30% elongation.

7. The apparatus of claim 1, wherein said base fabric is nylon with a percentage of elastic fibers oriented in said first direction.

8. The apparatus of claim 2, wherein said eye tape and said hook tape are attached to corresponding girth portions of a brassiere.

9. The apparatus of claim 2, wherein said eye tape further comprises stretchable backing material adjacent said base fabric on a side opposite said eyes wherein said backing material wraps around three edges of said base fabric and is heat-sealed to said base fabric on a side containing said eyes.

10. The apparatus of claim 2, wherein said eye tape further comprises parallel strips of stabilized material sewn to said base material, spaced apart from each other in said first direction, and used to mount said eyes to said base fabric.

11. A method of allowing dynamic girth adjustment of a garment, comprising providing the hook and eye closure of claim 1, to corresponding girth portions of said garment; and securing said garment using said hook and eye closure.

12. The method of claim 11, further comprising providing said hook and eye closure of to corresponding girth portions of a brassiere.

13. A method of forming a stretchable hook and eye closure for a garment, comprising:

forming an eye tape, said forming comprising:

providing a base fabric that elongates elastically in a first direction and is stabilized in a second direction perpendicular to said first direction;

positioning at least one eye column on said base fabric wherein said at least one eye column extends in said second direction; and securing at least one eye to said base fabric to form at least one eye row in said at least one eye column; and forming a hook tape, said forming a hook tape comprising:

providing a hook base fabric; and positioning one hook column in said second direction on said hook base fabric by securing at least one hook to form at least one hook row in said at least one hook column in said second direction, wherein said second direction of said hook base fabric is stabilized.

14. The method of claim 13, further comprising:

positioning a plurality of parallel eye columns spaced apart from each other in said first direction;

positioning a plurality of eye rows in each eye column spaced apart from each other in said second direction; and securing a plurality of hook rows in said one hook column spaced apart from each other in said second direction and corresponding in number to said plurality of eye rows.

15. The method of claim 13, wherein said hook base fabric is stabilized in said first direction.

16. The method of claim 13, wherein said hook base fabric elongates elastically in said first direction.

17. The method of claim 13, wherein said closure allows between about 10% and about 50% elongation.

18. The method of claim 13, wherein said closure allows between about 20% and about 30% elongation.

19. The method of claim 13, wherein said base fabric is nylon with a percentage of elastic fibers oriented in said first direction.

20. The method of claim 14, wherein said eye tape and said hook tape are attached to corresponding girth portions of a brassiere.

21. The method of claim 14, further comprising:

providing said eye tape with a stretchable backing material adjacent said base fabric on a side opposite said eyes;

wrapping said backing material around three edges of said base fabric; and heat-sealing said backing material to said base fabric on a side containing said eyes.

22. The method of claim 14, further comprising:

sewing parallel strips of stabilized material to said base material, spaced apart from each other in said first direction; and using said strips to mount said eyes to said base fabric.

* * * * *